US006845921B2

(12) United States Patent
Schorn

(10) Patent No.: US 6,845,921 B2
(45) Date of Patent: Jan. 25, 2005

(54) SHOWER HEAD FOR A SANITARY SHOWER

(75) Inventor: Franz Schorn, Schiltach (DE)

(73) Assignee: Hansgrohe AG, Echiltach (DE)

( * ) Notice: Subject to any disclaimer, the term of this patent is extended or adjusted under 35 U.S.C. 154(b) by 0 days.

(21) Appl. No.: 10/220,904

(22) PCT Filed: Feb. 27, 2001

(86) PCT No.: PCT/EP01/02187

§ 371 (c)(1),
(2), (4) Date: Oct. 21, 2002

(87) PCT Pub. No.: WO01/66263

PCT Pub. Date: Sep. 13, 2001

(65) Prior Publication Data

US 2003/0173421 A1 Sep. 18, 2003

(30) Foreign Application Priority Data

Mar. 9, 2000 (DE) ..... 100 11 503

(51) Int. Cl.[7] ..... F23D 11/04
(52) U.S. Cl. ..... 239/221; 239/380; 239/389
(58) Field of Search ..... 239/221, 240, 239/380, 383, 389, 451, 452, 457

(56) References Cited

U.S. PATENT DOCUMENTS

| | | | | | |
|---|---|---|---|---|---|
| 4,018,385 | A | | 4/1977 | Bruno | |
| 4,340,177 | A | | 7/1982 | Huber | |
| 4,568,023 | A | * | 2/1986 | Hayes | 239/242 |
| 4,944,457 | A | | 7/1990 | Brewer | |
| 4,989,786 | A | * | 2/1991 | Kranzle et al. | 239/240 |
| 5,108,035 | A | | 4/1992 | Friedrichs | |
| 5,169,072 | A | | 12/1992 | Gulyas | |
| 5,395,053 | A | * | 3/1995 | Frech | 239/227 |
| 5,598,975 | A | * | 2/1997 | Jager | 239/237 |
| 5,704,547 | A | * | 1/1998 | Golan et al. | 239/11 |
| 5,722,592 | A | * | 3/1998 | Jager | 239/227 |
| 5,941,458 | A | | 8/1999 | Hartmann | |
| 6,155,494 | A | * | 12/2000 | Fabbri et al. | 239/240 |
| 6,186,414 | B1 | * | 2/2001 | Clearman et al. | 239/214 |
| 6,196,475 | B1 | * | 3/2001 | Jaeger | 239/381 |
| 6,250,566 | B1 | * | 6/2001 | Jager | 239/237 |

FOREIGN PATENT DOCUMENTS

| | | | |
|---|---|---|---|
| DE | 197 35 550 | | 1/1998 |
| DE | 199 12 104 | | 9/2000 |
| GB | 2193446 A | * | 2/1988 |
| WO | WO 00/03810 | | 1/2000 |
| WO | WO 00/10720 | | 3/2000 |

OTHER PUBLICATIONS

Copy of PCT Search Report.
Copy of German Search Report.

* cited by examiner

*Primary Examiner*—William C. Doerrler
*Assistant Examiner*—Mohammad M. Ali
(74) *Attorney, Agent, or Firm*—Duane Morris LLP

(57) ABSTRACT

A shower head contains a jet outlet element, which is pivotably mounted in the shower head. It is moved by a mechanism in such a way that a guide journal remote from the outlet opening is moved along two closed, touching circles. At the point where the two circles touch, the guide journal can be moved from one circle into the other with the aid of a transfer device.

17 Claims, 2 Drawing Sheets

SHOWER HEAD FOR A SANITARY SHOWER

Figure 1:
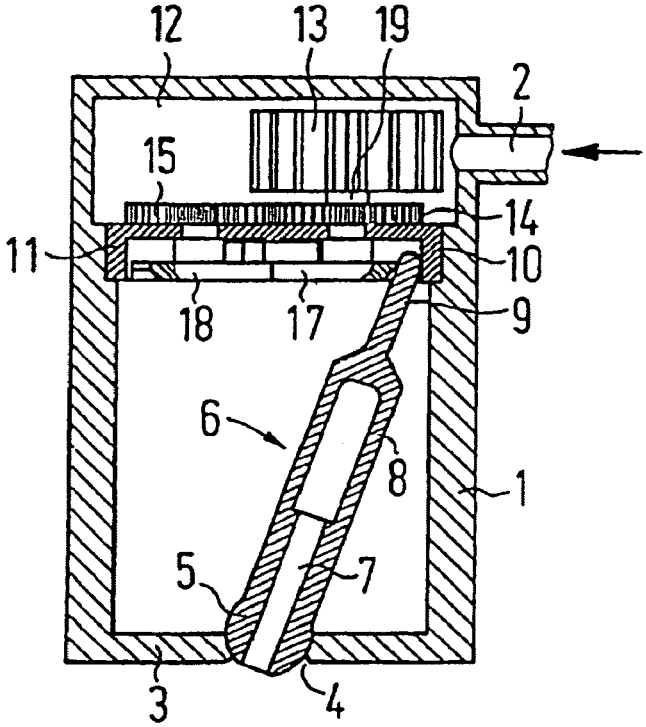

There are numerous possibilities for controlling the jets passing out of a shower head in order to give specific effects to the shower user. These can be optically visible effects, or also effects perceived as a massage.

In a known shower head (WO 00/03810) a jet outlet element is to a certain extent arranged in freely movable manner in a shower head. It is provided with a turbine, which can be driven by the water flow. As a result of the free mobility together with the turbine, the jet outlet element can be given a random orientation, so that it performs any random uncontrolled movement.

The problem of the invention is to provide a shower head with which it is possible to implement different patterns of moving outlet jets.

To solve this problem the invention proposes a shower head as disclosed in this specification and as defined in the claims, whose wording, like that of the abstract, is by reference made into part of the content of the present description.

Through the movement of the jet outlet element retained in the shower head with the aid of the mechanism, it is possible to modify the direction of the jet passing out of the jet outlet element. If this modification takes place rapidly an interesting jet pattern is obtained for the user and this also leads to a massaging action of the skin of the showering person.

According to a further development of the invention, the arrangement is such that the direction of the jet passing out changes in a constantly repeating pattern. However, it is also conceivable and is proposed by the invention, that a random pattern is produced.

In order to change the direction of the jet passing out, according to a further development of the invention a guide segment of the jet outlet element is movable along a path, which preferably describes a closed path, which is preferably closed. The guide segment can be a specific part of the jet outlet element, which is e.g. positioned as a journal on the end of the jet outlet element remote from the jet disk.

The guideway bringing about the movement of the jet outlet element can, in a further development of the invention, have at least one crossing. As a result it is possible to produce jets which describe the shape of a figure of eight on the impact surface and where there is an actual crossover of the path.

According to another further development of the invention, the guideway has at least two closed paths with a transfer point between them. An example for this is the provision of two circular paths, which intersect or touch at at least one point. At said point it is possible to provide a device in order to transfer the guide segment from one path to the other.

It can in particular be provided that the paths are in tangential contact at the transfer point. At the transfer point can be provided an optionally controlled transfer device.

The mechanism bringing about the movement of the jet outlet element can e.g. be driven by a turbine, which is driven by the water flowing the shower head.

It can in particular be provided that the mechanism has at least one mechanism element with which at least temporarily the jet outlet element is directly connected. For example, the aforementioned guide segment can engage in a recess of the mechanism element and is moved by the latter. Engagement can be such that the guide segment still has a degree of freedom, which is determined by another part of the shower head.

Thus, the mechanism can e.g. be constructed in such a way that the mechanism element brings about the movement of the jet outlet element, i.e. for example a rotary drive, or in such a way that the mechanism element directly controls the movement of the jet outlet element.

According to a further development of the invention, the shower head can have a second or also a third mechanism element with which the jet outlet element is temporarily directly connected, i.e. for example during the time when it is not connected to the first mechanism element.

According to the invention, the mechanism can have a transfer device in order to transfer the jet outlet element or its guide segment from one to the other mechanism element.

The transfer device can e.g. be constructed in such a way that it directly controls the jet outlet element movement.

However, it is also possible and is proposed by the invention, that the transfer device is controlled by a gear means, which can be synchronized with the jet outlet element movement, or a non-synchronized gear means. In this case it is possible to bring about a random movement.

According to a further development of the invention, the jet outlet element is moved in such a way that its axis is located on a cone. This can e.g. be brought about in that one end of the jet outlet element is retrained or guided in the manner of a ball and socket joint or a ball socket.

It is also possible and is proposed by the invention, that the jet outlet element moves parallel to itself, i.e. is slid.

In particular, combinations of both movement types are possible.

Further features, details and advantages of the invention can be gathered from the following description of a preferred embodiment, together with the attached drawings, wherein show:

FIG. 1 A section through the diagrammatically represented shower head according to the invention.

Figure 2:
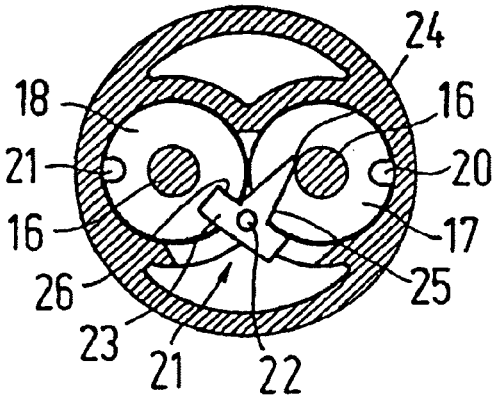

FIG. 2 A cross-section through the arrangement of FIG. 1.

Figure 3:
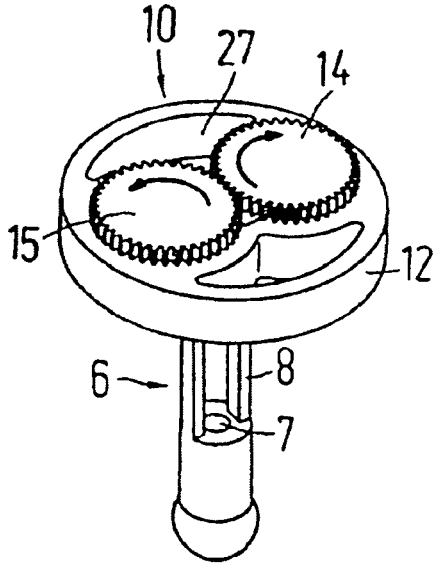

FIG. 3 Perspectively the view of part of the mechanism of the arrangement of FIG. 3.

Figure 4:
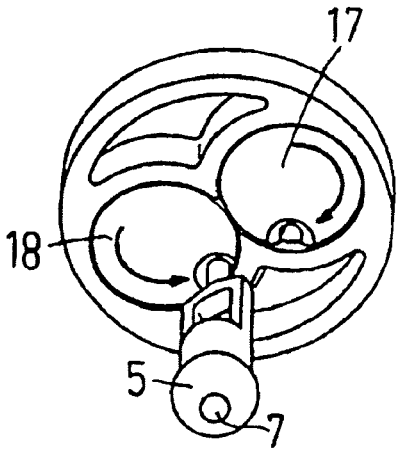

FIG. 4 The arrangement of FIG. 3 from below.

Figure 5:
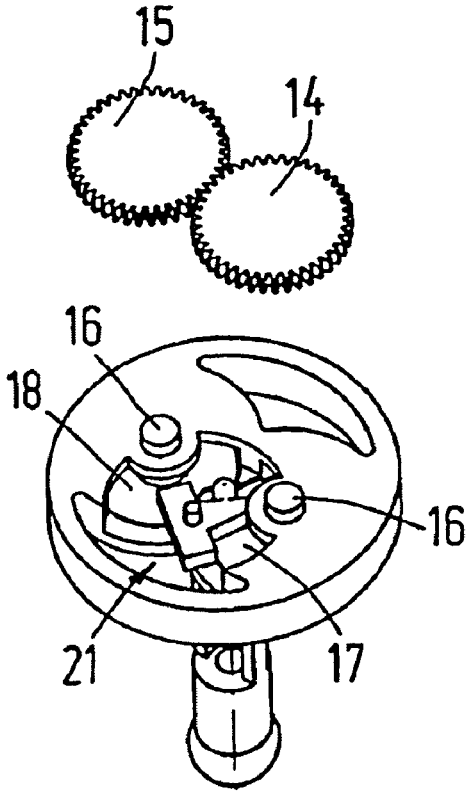

FIG. 5 The arrangement of FIG. 3 with the toothed gears removed.

Figure 6:
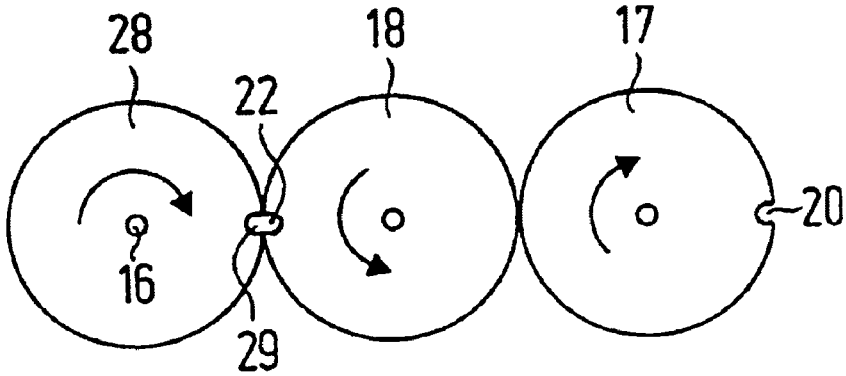

FIG. 6 Diagrammatically an example for an arrangement with three mechanism elements.

Figure 7:
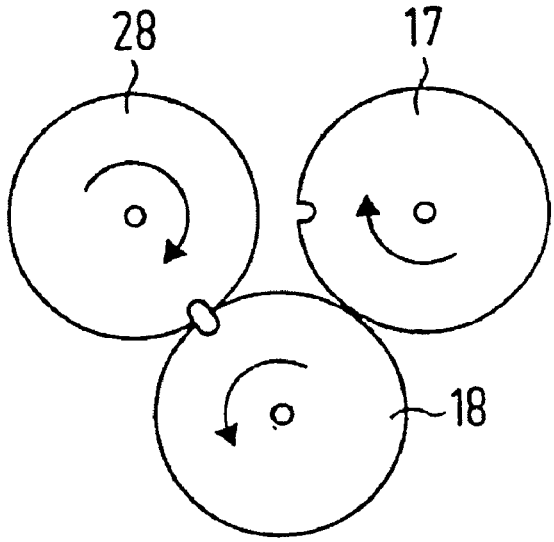

FIG. 7 A further arrangement with three mechanism elements.

FIG. 1 shows in section and highly diagrammatic form a shower head with a casing 1 into which issues a water inlet 2. On the opposite end face is formed a jet disk 3 having an opening 4. Into the casing 1 the opening 4 is constructed as a type of ball socket in which is mounted the front, spherically shaped end 5 of a jet outlet element 6. In its front region the jet outlet element 6 is constructed as a sleeve, which is traversed by an axial bore 7. To the front, sleeve-like region are connected two parallel webs 8, which then pass into a journal-like, cylindrical guide segment 8 arranged in the axial extension of the axial bore. The shape of the jet outlet element can also be gathered from FIGS. 3 and 4.

In the upper region of the casing in FIG. 1 is inserted an insert part 10, which is roughly in the form of a plate with a cylindrical edge 11, which is constructed as a flat cylindrical surface and is located on a shoulder in the casing. The insert 10 longitudinally subdivides the casing roughly in a ratio of 1:4. On the upper side of the insert 10 in FIG. 1 a chamber 12 is formed, which houses a mechanism with a turbine 13. The turbine 13 is positioned in such a way that it is rotated by the water jet entering the casing 1 through the inlet 2. It is in engagement by means of a shaft 19 and a pinion with a first toothed gear 14, which meshes with a second toothed gear 15. Both gears 14, 15 are mounted in the plate of the insert 10. Below the plate 10, a disk 17, 18 is connected to rotate via in each case one shaft 16 with the corresponding gear. The two disks 17, 18 have a size such that their outer circumferences are in contact at a central point. In the represented example the two gears 14, 15 are of the same size, so that they are driven in contrarotating manner at the same rotational speed. As a result the two disks 17, 18 contrarotate at the same circumferential speed. Each of the two disks 17, 18 has a notch 20, 21 emanating from its circumference and said notches are dimensioned in such a way that they take up the upper area of the guide segment 9 of the jet outlet element 6 and can provide guidance with a limited lateral clearance. If the turbine 13 rotates, the guide segment 9 of the jet outlet element moves along a circular guideway, which can e.g. be seen from the section in FIG. 2. If it is assumed that the guide segment 9 is to the right in notch 20, during the rotation of the turbine the notch 20 with the guide segment is entrained counter-clockwise by the disk 17. In the cross-sectional centre of the casing, where the outer circumferences of the two disks 17, 18 touch, is provided a point where it is possible to transfer the guide segment 9 of the jet outlet element from the notch 20 of one disk 17 into the notch 21 of the other disk 18. This presupposes that the notches are in contact at this point. This is the case in the embodiment shown, as can be gathered from FIG. 2. For transferring the guide segment 9 a transfer device 21 is provided. It contains a symmetrically constructed switch 23 pivotable about a fixed shaft 22 and having a nose section 24, which is sufficiently long that it engages with its one side on the shaft 16. The nose section 24 is bilaterally bounded by a guide bevel 25, which passes into a control section at right angles to the guide bevel 25. If the guide segment 9 were rotated by 180° with respect to the representation of FIG. 2, it would arrive on the sloping guideway 25 and would be moved by the latter from the notch 20 into the notch 21 of the second disk 18. As soon as it was moved on further by the second disk 18, the guide segment 19, without any possibility of lateral deflection, would reach the guide section 26 and pivots the latter about the shaft 22. This leads to a tilting over of the switch until the nose 24 engages on the other shaft 16. In the case of a further rotation by a full circle, the guide segment is then moved into the notch 20 of the first disk, so that it can again switch over the transfer device 21. Thus, the guide segment 9 moves along a figure of eight with a crossover point.

FIG. 3 perspectively shows a view of the insert 10 with the two toothed gears 14, 15 and the jet outlet element 6 below the insert 10. The plate used for mounting the shafts 16 is laterally provided alongside the gears 14, 15 with large openings 27 through which the water can flow out of the chamber 12 into the area where the jet outlet element 6 is located. From there the water can flow between the two webs 18 into the axial bore 7 and from there pass out of the shower head. The water passes out of the jet disk 3 in the direction just assumed by the jet outlet element 6. If the shower head is held over a surface, the water jet describes thereon a figure of eight.

FIG. 4 shows the arrangement of FIG. 3 from below. It is once again possible to see the two disks 17, 18, which are connected to rotate with in each case one of the two gears 14, 15 on a common shaft.

FIG. 5 is a representation corresponding to FIG. 3 in which the two gears 14, 15 are removed, so as to make it easier to see the two shafts 16. The position of the transfer device 21 between the two disks 17, 18 is also clearly visible.

The embodiment of FIGS. 1 to 5 illustrates a possibility for the technical implementation of a shower head, in which the water jet passing out of the said head describes a figure of eight on a surface consisting of two tangentially contacting, equally large circles with a crossover point at the contact point. This shape of the path described by the water jet on the surface during its impact is brought about by the guideway of the guide segment 9 of the jet outlet element 6. This guideway is geometrically similar to the shape described by the water jet.

However, the invention also allows other paths of the water jet when it strikes a surface. One such possibility is diagrammatically illustrated in FIG. 6. In place of two disks 17, 18, here three disks 17, 18, 28 are used, which are in each case driven in contrarotating manner and whose axes are on one line. A guide segment 9 of a corresponding jet outlet element, much as in the embodiment of FIG. 2, is initially moved along a closed circle from a disk 17 or 28 located at one end until it reaches the central disk 18, where it is transported over a semicircle to the in each case other, outer disk and during its return over the other semicircle.

In FIG. 7 the three disks 17, 18, 28 are arranged in such a way that the axes are not on a single line and instead form the angles of a triangle. Here the guide segment is moved from the two outer disks 17, 18 over in each case a full circle, whereas it is moved over an arc of approximately 300° by the central disk 18 during its revolution from disk 28 to disk 17. During the return movement of disk 17 to disk 18, it is moved over an arc of approximately 60°.

In the embodiment more precisely shone in FIGS. 1 to 5, the front portion of the jet outlet element 6 is held in a ball socket. It is also conceivable for the jet outlet element not only to be pivoted about a joint, but also or exclusively for it to be shifted in accordance with a guideway. However, preference is given to the pivoting movement.

In the embodiments shown or intimated in FIGS. 6 and 7, it is also possible for the shafts 16 of the three disks not to be parallel to one another, but being instead somewhat crossed in order to better correspond to the pivoting movement of the jet outlet element 6.

What is claimed is:

1. A shower head for a sanitary shower, comprising:

a casing terminated by a jet disk, at least one jet outlet element, which is movably retained in the shower head, as well as with a mechanism for moving the jet outlet element in such a way that a direction of a water jet passing out of the jet outlet element is continuously modified with respect to the casing, further comprising a guide segment of the jet outlet element, wherein the guide segment is movable along at least two closed paths with at least one transfer point for crossing between the paths.

2. The shower head according to claim 1, wherein the direction is changed in a constantly repeating pattern.

3. The shower head according to claim 1, wherein the paths are in tangential contact at the transfer point.

4. The shower head according to claim 1, further comprising a transfer device at the transfer point.

5. The shower head according to claim 1, wherein the mechanism can be driven by a turbine.

6. The shower head according to claim 1, wherein the mechanism has at least one mechanism element with which the jet outlet element is at least temporarily directly connected.

7. The shower head according to claim 1, wherein the mechanism determines a movement of the jet outlet element.

8. The shower head according to claim 6, further comprising a second mechanism element with which the jet outlet element is temporarily directly connected.

9. The shower head accordingly to claim 8, further comprising a transfer device for transferring the jet outlet element from the first to the second mechanism element.

10. The shower head according to claim 9, wherein the transfer device is controlled by actual movement.

11. The shower head according to claim 6, wherein the transfer device (21) is controlled by a gear means.

12. The shower head according to claim 1, wherein the jet outlet element is moved to define a conical path.

13. The shower head according to claim 1, wherein the jet outlet element is moved so as to remain parallel to itself.

14. The shower head according to claim 1, wherein the jet outlet element performs a combination of a pivoting and a sliding movement.

15. The shower head according to claim 8, further comprising a further mechanism element with which the jet outlet element is temporarily directly connected.

16. The shower head of claim 11, wherein the gear means is synchronized.

17. The shower head of claim 11, wherein the gear means is non-synchronized.

* * * * *